United States Patent [19]

Staufer et al.

[11] 4,148,502

[45] Apr. 10, 1979

[54] CROSS-COUNTRY SKI BINDING

[75] Inventors: Adolf Staufer; Rudolf Hieblinger, both of Ried im Innkreis, Austria

[73] Assignee: Fischer Gesellschaft m.b.H., Ried im Innkreis, Austria

[21] Appl. No.: 816,947

[22] Filed: Jul. 19, 1977

[30] Foreign Application Priority Data

Jul. 22, 1976 [AT] Austria ..... 5397/76
Jul. 22, 1976 [AT] Austria ..... 5398/76

[51] Int. Cl.[2] ..... A63C 9/18
[52] U.S. Cl. ..... 280/615
[58] Field of Search ..... 280/615, 614, 635, 611

[56] References Cited

U.S. PATENT DOCUMENTS

| | | | |
|---|---|---|---|
| 2,469,478 | 5/1949 | Ruud | 280/615 |
| 3,603,606 | 9/1971 | Eie | 280/615 |
| 3,612,558 | 10/1971 | Kjellstrom | 280/615 |
| 3,794,338 | 2/1974 | Smolka | 280/629 |

FOREIGN PATENT DOCUMENTS

| | | | |
|---|---|---|---|
| 263641 | 9/1931 | Fed. Rep. of Germany. | |
| 2304466 | 8/1973 | Fed. Rep. of Germany. | |
| 19021 | 6/1909 | Norway | 280/623 |
| 59295 | 4/1938 | Norway | 280/615 |
| 147184 | 8/1931 | Switzerland | 280/615 |
| 224444 | 2/1943 | Switzerland | 280/615 |

*Primary Examiner*—Joseph F. Peters, Jr.
*Assistant Examiner*—Milton L. Smith
*Attorney, Agent, or Firm*—Fleit & Jacobson

[57] ABSTRACT

A cross-country ski binding comprises a toe iron which has two side portions, which extend substantially at right angles to the tread and engage at least one portion which projects from the sole of the skiing boot in front of its toe portion. A clamping member serving to retain the projecting portion is pivoted at least at one end to one side portion. In position for use, the clamping member extends transversely to the longitudinal direction of the ski. The clamping member is pivotally movable in a plane which is transverse to the longitudinal direction of the ski. At its other end, the clamping member is adapted to be releasably locked to the other side portion of the toe iron. In a top plan view, the toe iron has a constriction which is disposed in front of the tip of the foot and which is preferably narrower than the foot. The portion which projects from the sole has a recess which registers with the constriction.

11 Claims, 4 Drawing Figures

CROSS-COUNTRY SKI BINDING

SUMMARY OF THE INVENTION

A cross-country ski binding comprises a toe iron which has two side portions, which extend substantially at right angles to the tread and engage at least one portion which projects from the sole of the skiing boot in front of its toe portion. A clamping member serving to retain the projecting portion is pivoted at least at one end to one side portion. In position for use, the clamping member extends transversely to the longitudinal direction of the ski. The clamping member is pivotally movable in a plane which is transverse to the longitudinal direction of the ski. At its other end, the clamping member is adapted to be releasably locked to the other side portion of the toe iron.

The cross-country ski binding also comprises a toe iron which has upturned longitudinal edge portions. A portion which projects from the sole of a cross-country skiing boot is received between said edge portions. Close to the forward ends of said edge portions, inwardly bulged portions, which face each other, extend from said edge portions. These bulged portions engage recesses in the portion projecting from the sole of the boot.

This invention relates to a cross-country ski binding which comprises a toe iron that has two side portions, which extend substantially at right angles to the tread. These side portions engage at least one portion which projects from the sole in front of the toe portion of the skiing boot. A clamping member serves to retain the projecting portion and is pivoted at least at one end to one of the side portions.

Known cross-country ski bindings comprise portions for guiding the toe portion of the skiing boot and further comprise a U-shaped member, which at its limb ends is pivoted to the toe guiding members and when swung down is adapted to be fixed in position by means of a racklike lever, which is pivoted to the forward end of the toe iron in the longitudinal center plane. To prevent a slipping toward the rear, the soleplate of the toe iron is provided with upstanding spikes, which are received in holes formed in the underside of the skiing boot adjacent to the portion which projects from the sole. In a similar cross-country ski binding, the skiing boot is fixed in position by studs, which snap in from above. Such bindings are relatively bulky and substantial portions of their lateral guides protrude beyond the longitudinal edges of the skis so that a high friction results in the cross-country trail.

Swiss Patent Specification No. 147,184 discloses an angled toe iron, which conforms to the wedgelike shape of the foot, and a narrow guide bar, which is hooked to the toe iron adjacent to the toe portion of the boot and which engages a mating groove formed in a fixture which is attached to the edge of the sole on both sides of the upper of the boot. Because the resulting constriction must be wider than the foot, the ski binding has an excessive width and for this reason cannot be used with inherently narrow cross-country skis.

Other known cross-country ski bindings comprise toe irons which are disposed in front of the toe and metatarsal portions of the skiing boot and which have a forward end portion which is boxlike in cross-section and adapted to receive a portion which projects from the sole of the skiing boot. A locking bolt is inserted into said forward end portion and projecting portion from the side to hold the projecting portion in position. Whereas that toe iron is small in bulk and for this reason gives rise to less friction in the cross-country trails and is also lighter in weight, the fixation of the boot is a complicated operation and the locking bolt may become lost.

It is an object of the invention to provide a toe iron which has the advantage of the one described last hereinbefore but is free from the disadvantages thereof. In a cross-country ski binding of the kind defined first hereinbefore, this object is accomplished in accordance with the invention in that the clamping member extends in position for use transversely to the longitudinal direction of the ski and is pivotally movable in a plane which is transverse to the longitudinal direction of the ski and the clamping member is adapted to be releasably locked at its other end to the other side portion of the toe iron.

According to an additional feature of the invention, the clamping member consists of resilient material and the portion which projects from the sole and/or the clamping member has such a curvature that when the clamping member is swung down and releasably locked in position the spring is so highly stressed that the portion projecting from the sole of the skiing boot cannot slip out under the clamping member. This arrangement eliminates the need for providing additional bolts, pawls or the like locking means, which have been used in known cross-country ski bindings to prevent a slipping of the boot toward the rear.

According to another feature of the invention, the toe iron has in a top plan view a constriction, which is disposed in front of the tip of the foot and is preferably narrower than the foot and the portion which projects from the sole has a recess, which registers with the constriction so that retaining means are provided for releasably locking the portion which projects from the sole so that said portion cannot lift from the toe iron.

According to an additional feature of the invention, the retaining means for locking the portion which projects from the forward end of the sole comprise a clamping member, which extends in the longitudinal direction of the ski and is pivoted at one end on an axis which extends in the longitudinal direction of the ski, and said clamping member is adapted to be releasably locked at its other end.

An additional feature of the ski binding according to the invention resides in that the skier can step into the binding from above so that the skiing boot cannot slip in the forward direction, as in the known bindings, into which the skiing boot is inserted in said forward direction.

Further details of the invention will be explained more fully with reference to the drawing, which shows illustrative embodiments of a cross-country ski binding according to the invention and of a skiing boot designed for use with that binding.

Figure 1:
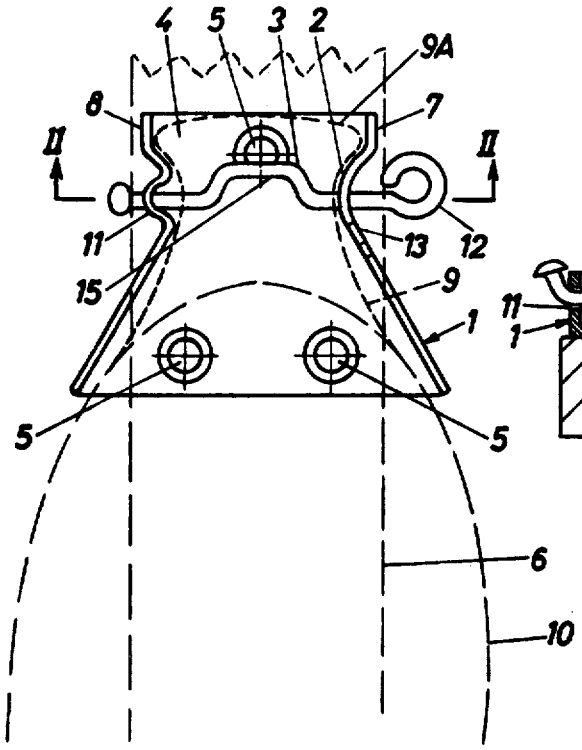
FIG. 1 is a top plan view showing the toe iron of the cross-country ski binding and the skiing boot, which is only diagrammatically indicated.
Figure 2:
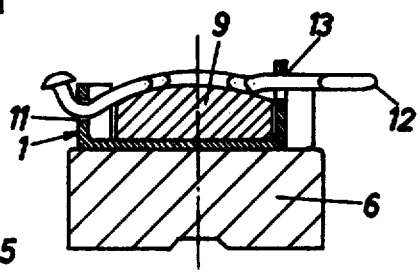
FIG. 2 is a sectional view taken on line II-II in FIG. 1 with the boot inserted.
Figure 3:
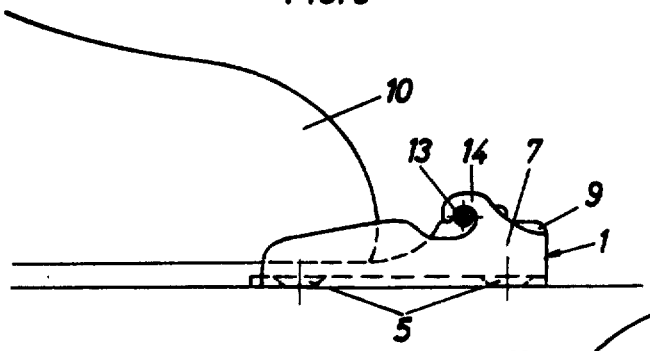
FIG. 3 is an elevation showing the toe iron viewed from the right hand side, with the skiing boot inserted and the handle cut off.
Figure 4:
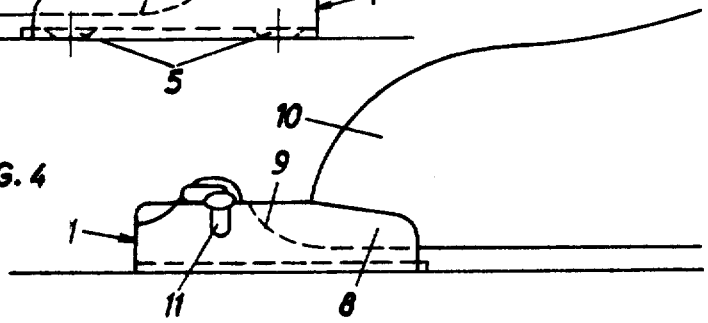
FIG. 4 is an elevation showing the toe iron viewed, from the left hand side also with the boot inserted.

The toe iron 1 of the cross-country binding according to the invention converges in a top plan view toward the tip of the ski and near its forward end has a constriction 2. A clamping member 3 extends transversely to the longitudinal axis of the ski over said constriction. The toe iron 1 has a soleplate 4, which has holes 5, which serve to receive screws for fixing the soleplate to the ski 6. A portion 9 projecting from the sole of a cross-country skiing boot is received between upturned longitudinal edge portions 7, 8 of the soleplate 4. The side edge of the portion 9 which projects from the sole conforms to the side of the toe iron 1 and has a corresponding constriction or throat, which ensures that the cross-country skiing boot 10 which has been introduced into the toe iron from above will be fixed in the longitudinal direction of the ski.

The clamping member 3 consists of resilient material and at one end is pivoted in an aperture 11 provided in the upturned longitudinal edge portion 8. The other end of the clamping member 3 forms a curved handle 12 and is adapted to be releasably locked in a recess 13, which is formed in the longitudinal edge portion 7 and defines a hook 14, which is downwardly open.

The projecting portion 9 has a curved top, i.e., it is arcuate or cambered in a sectional plane that is transverse to the longitudinal direction of the ski. To facilitate the tightening of the clamping member 3, this curvature is non-symmetrical and its apex is near the aperture 11 in which the clamping member is pivoted.

The clamping member 3 has an offset portion 15, which prevents a rotation of the clamping member about its axis in its clamping position. Instead of the offset portion shown in the drawing, the clamping member may be provided for the same purpose with any desired portion which is curved in the longitudinal direction of the ski when the clamping member is in clamping position, or with a flat portion. In the present case the clamping member is made from a length of spring wire. Also, the pivoted clamping member 3 may be replaced by other retaining means, which are attached to the toe iron and when the binding is closed engage the portion 9 which projects from the sole so that said portion cannot lift from the toe iron.

As has been mentioned hereinbefore as an advantage of the invention, the skier steps into the toe iron 1 from above when the clamping member 3 has been swung open. The clamping member 3 is then swung down to its clamping position and is thus subjected to a progressively increasing stress, and is finally caused to be releasably locked in the recess 13. The binding has now been closed and retains the sole of the skiing boot. A slipping of the projecting portion 9 under the clamping member 3 may be prevented by various means, e.g., by the provision of a laterally enlarged portion 9A or of a vertically enlarged portion of the projecting portion in front of the constriction 2 so that the projecting portion can bear against the inwardly curved portions of the longitudinal edge portions 7, 8 or, in case of a vertically enlarged portion, against the clamping member 3.

Because the sole of the skiing boot and possibly also the upper thereof is made from plastics material by injection molding or casting or other operations, the portion 9 which projects from the sole can easily be provided in any desired shape which is suitable for the desired purpose.

It will be understood that various modifications in design may be adapted within the scope of the invention. For instance, the curvature provided for the top of the portion 9 which projects from the sole may alternatively or additionally be provided on the clamping member 3. If the portion 9 which projects from the sole is sufficiently compressible, the clamping member 4 may be rigid or may have only a small resiliency.

What is claimed is:

1. A cross-country ski binding comprising a toe iron which has a soleplate for fixing the entire toe iron to a ski, said soleplate having longitudinally extending edge portions which are turned up to extend substantially at right angles to said soleplate and which constitute side portions which define a space that tapers toward the tip of the ski and serves to receive a portion which projects from the sole of a cross-country skiing boot in front of its toe portion, said toe iron further comprising a clamping member for holding the projecting portion in position, said clamping member having a first end pivotally connected to a part of one of said side portions and a second end adapted to be releasably locked directly to a part of the other of said side portions, said clamping member being movable in a plane that is transverse to the longitudinal direction of the ski to releasably lock said second end to the other of said side portions.

2. A cross-country ski binding according to claim 1, wherein the clamping member is comprised of resilient material.

3. A cross-country binding according to claim 2, wherein said clamping member comprises spring wire and wherein said clamping member includes a portion intermediate its ends which is offset substantially in the longitudinal direction of the ski when the clamping member is in a clamping position.

4. A cross-country binding according to claim 2, wherein said clamping member in a clamping position is curved in a plane that is at right angles to the longitudinal direction of the ski.

5. A cross-country ski binding according to claim 1 wherein said space has a portion which is constricted in the direction that is transverse to the longitudinal direction of the ski, said constricted portion being positioned close to the parts of said side portions supporting said clamping member.

6. A cross-country ski binding according to claim 1, wherein said one side portion has an aperture formed therein for receiving said first end of said clamping member and wherein said other side portion has a recess defined therein for releasably locking the second end of said clamping member.

7. A combination of a cross-country ski binding and cross-country skiing boot comprising a skiing boot having a portion which projects from the forward end of a sole of the skiing boot, said projecting portion being provided with lateral recesses; and the ski binding having a toe iron for receiving said projecting portion, said toe iron comprising a soleplate for fixing the entire toe iron to a ski, said soleplate having longitudinally extending edge portions which are turned up to extend substantially at right angles to said soleplate to define a space and which constitute side portions which have inwardly bulged portions, which are spaced from a forward end of said side portions and extend into the space which is defined by said side portions and define a constriction and cooperate with said lateral recesses of the projecting portion, and retaining means extending between and connected to said side portions for releasably locking said projecting portion against lifting from the toe iron.

8. The combination as set forth in claim 7, wherein the retaining means comprise a clamping member, which extends in the transverse direction of the ski in a clamping position and is pivoted at one end to one of said side portions on an axis which extends in the longitudinal direction of the ski, and said clamping member is adapted to be releasably locked at its other end to the other of said side portions.

9. The combination as set forth in claim 8, wherein the clamping member is curved upwardly in a cross-sectional plane extending in a direction which is transverse to the longitudinal direction of the ski and the curvature is asymmetrical and has an apex near the point where the clamping member is pivoted.

10. The combination according to claim 8, wherein said clamping member comprises spring wire and wherein said clamping member includes a portion intermediate its ends which is offset substantially in the longitudinal direction of the ski when the clamping member is in a clamping position.

11. The combination as set forth in claim 7, wherein the side portions taper inwardly from their rear end to the constriction.

* * * * *